United States Patent [19]

Bornhofen

[11] Patent Number: 4,608,466

[45] Date of Patent: Aug. 26, 1986

[54] STATOR FOR SWITCH ASSEMBLY

[75] Inventor: James A. Bornhofen, Aurora, Ill.

[73] Assignee: Standard Grigsby, Inc., Aurora, Ill.

[21] Appl. No.: 777,574

[22] Filed: Sep. 19, 1985

Related U.S. Application Data

[63] Continuation of Ser. No. 508,134, Jun. 27, 1983, abandoned.

[51] Int. Cl.[4] ..... H01H 1/00; H01H 19/00; H01H 21/00

[52] U.S. Cl. ..... 200/11 D; 200/273

[58] Field of Search ..... 200/11 R, 11 A, 11 D, 200/11 DA, 11 G, 11 TW, 15, 237, 238, 239, 273, 284, 292

[56] References Cited

U.S. PATENT DOCUMENTS

| | | | |
|---|---|---|---|
| 873,005 | 12/1907 | Ball | 200/284 |
| 2,606,264 | 8/1952 | Jacobi | 200/284 |
| 2,612,577 | 9/1952 | Jacobi | 200/284 X |
| 2,631,211 | 3/1953 | Klay | 200/11 D X |
| 2,650,286 | 8/1953 | Ramos | 200/284 |
| 2,988,606 | 6/1961 | Allison | 200/11 D |
| 3,248,488 | 4/1966 | Stephan | 200/11 D |
| 3,261,929 | 7/1966 | Neff, Jr. | 200/11 D |
| 3,531,861 | 10/1970 | Golbeck | 200/11 D X |
| 3,571,535 | 3/1971 | Beaver et al. | 200/284 X |
| 3,586,797 | 6/1971 | Gerhardt | 200/11 DA X |
| 3,609,257 | 9/1971 | Jinsenji | 200/11 D |
| 4,019,000 | 4/1977 | Robinson | 200/11 D |
| 4,133,990 | 1/1979 | Wanner et al. | 200/11 R X |
| 4,172,218 | 10/1979 | Sugisaka | 200/11 R X |

FOREIGN PATENT DOCUMENTS

| | | | |
|---|---|---|---|
| 650955 | 10/1962 | Canada | 200/11 D |
| 765182 | 1/1957 | United Kingdom | 200/11 D |
| 831142 | 3/1960 | United Kingdom | 200/284 |

*Primary Examiner*—J. R. Scott

*Attorney, Agent, or Firm*—Wood, Dalton, Phillips, Mason & Rowe

[57] ABSTRACT

Am improved switch is set forth. The switch has an insulating housing supporting a plurality of flexible contacts fashioned from a first conductive material selected to impart flexibility and spring action to the contacts. Accordingly, the contacts can be biased to engage and maintain contact with the switch rotor which is manipulated to produce the desired switching. Welded to each contact is a terminal connector extending to the exterior of the housing for connection to wires. The terminal connectors are fashioned from a second conductive material selected for strength and durability to prevent breakage.

6 Claims, 6 Drawing Figures

STATOR FOR SWITCH ASSEMBLY

This application is a continuation of application Ser. No. 06/508,134, filed June 27, 1983, now abandoned.

BACKGROUND OF THE INVENTION

1. Field of the Invention

This invention relates to electric switches and more particularly to the construction of the switch and the conductive elements used in the switch.

2. Description of the Prior Art

It is known in the prior art to provide electric switches in circuits to selectively conduct or not conduct electricity as desired throughout the circuit. An exemplary switch known by those skilled in the prior art has an insulating carrier containing a number of electrical contacts. Each contact is, in turn, connected to an external terminal connector which provides a means to interconnect each contact to the wires of the electric circuit. In many switches the contacts engage a rotor which is rotated to conductively interconnect the various contacts to permit electricity to flow from one or more terminal connectors to one or more of the other terminal connectors to provide the desired switching effect. Typically the rotor is rotated by a knob or the like to indicate the position of the rotor and the interconnection of contacts. To maintain the engagement between the contacts and the rotor, the contacts have been fashioned from flexible conductive materials. The flexibility of the conductive material permits each contact to be biased against the rotor to maintain the conductive engagement therebetween.

One known method for fashioning the contacts and terminal connectors is by stamping the contact-terminal connector pattern for the switch from a sheet of conductive material. As stated above, the material is selected to give the contacts the desired biasing flexibility or "spring action" so that the contacts will properly bias against the rotor. After the pattern has been stamped from the sheet, the sheet is insert molded into a non-conductive carrier, the carrier ultimately forming a part of the switch.

One of the drawbacks of the aforementioned switches is that the conductive material selected to give the desired flexibility and spring action to the contacts is not strong or rigid enough for the terminal connector to connect the switch to the circuit. Accordingly, the terminal connector of switches such as described above, tend to break, rendering the switch useless.

SUMMARY OF THE INVENTION

It is an object of the present invention to overcome the drawback noted above.

Toward this end, a stator is set forth for a switch of the type having a rotor. Within the switch are a plurality of contacts which are electrically interconnected by rotation of the rotor. Each contact is fashioned from a flexible, conductive first material selected to give each contact the desired spring action. Welded to each contact and extending to the exterior of the housing is a terminal connector fashioned from a second conductive material selected for durability and strength. The contacts and their terminal connectors are insert molded into a non-conductive carrier which is then assembled into the switch. The carrier envelops the weld between the contact and terminal connector to relieve the weld from stresses imposed on the contact and terminal connectors.

Accordingly, it is an object of the present invention to set forth a switch wherein the stator has contacts which are fashioned from a conductive first material selected for its flexibility and spring action and wherein each terminal connector is fashioned from a conductive second material more strong and durable than the first material to prevent the terminal connectors from breaking from the switch.

Further objects and advantages will become evident upon a reading of the specification, drawings and attached claims.

DESCRIPTION

Figure 1:
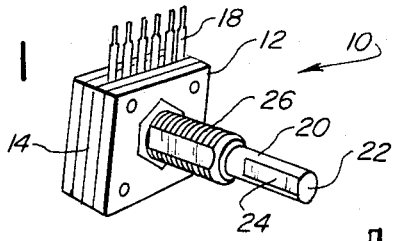
FIG. 1 is a perspective view of a typical switch according to the present invention.

Turning to FIG. 1, a switch 10 according to the present invention is shown. The switch 10 has a supporting and electrically insulating housing 12. As will become apparent by the following description, the switch 10 could have any shape housing or could differ in operation from the switch hereinafter set forth. The housing 12 includes a rectangular carrier 14 described in detail below. Within the carrier 14 are stator contacts 16 (not shown in FIG. 1) each connected to a terminal connector 18 extending to the exterior of the housing 12. The terminal connectors 18 are adapted to be connected to wires or the like in an electrical circuit. In a known manner, the switch 10 also includes a rotor (not shown) in the housing 12, the rotor having a conductive portion or portions to, upon rotation of the rotor, electrically interconnect or disconnect two or more contacts 16 to provide the switching function for the circuit. To rotate the rotor, the switch 10 includes a shaft 20 extending to the exterior of the housing 12 and having an end 22 with a flat 24 adapted to mount a control knob or the like. A threaded sleeve 26 secured to the housing 12 supports the rotation of the shaft 20 for rotation of the rotor and, in cooperation with a nut (not shown), provides the means to mount the switch 10 to a control panel or the like.

Figure 2:
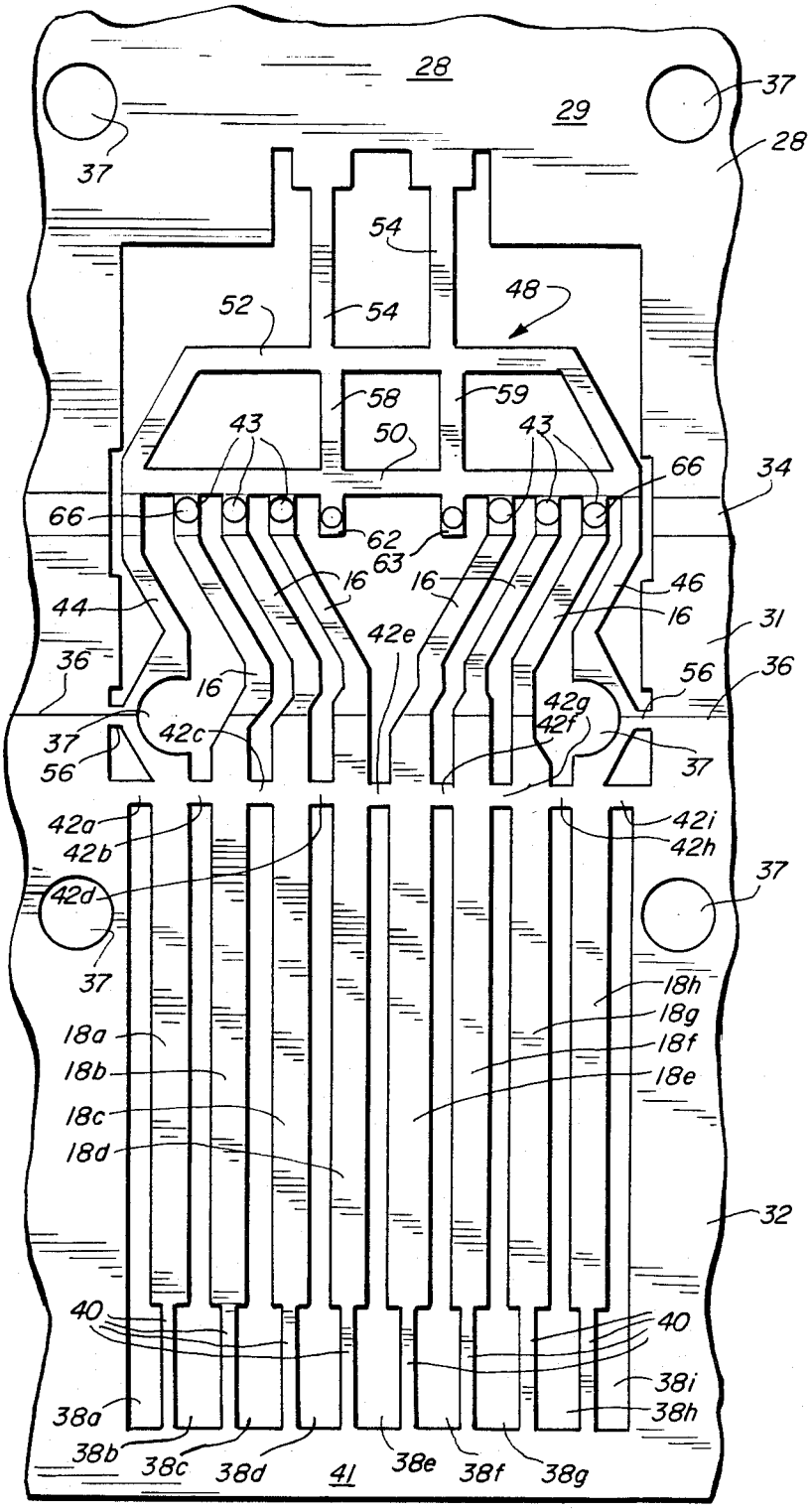
FIG. 2 is a plan view of the contact-terminal connector pattern stamped from a sheet of material according to the present invention.
Figure 3:
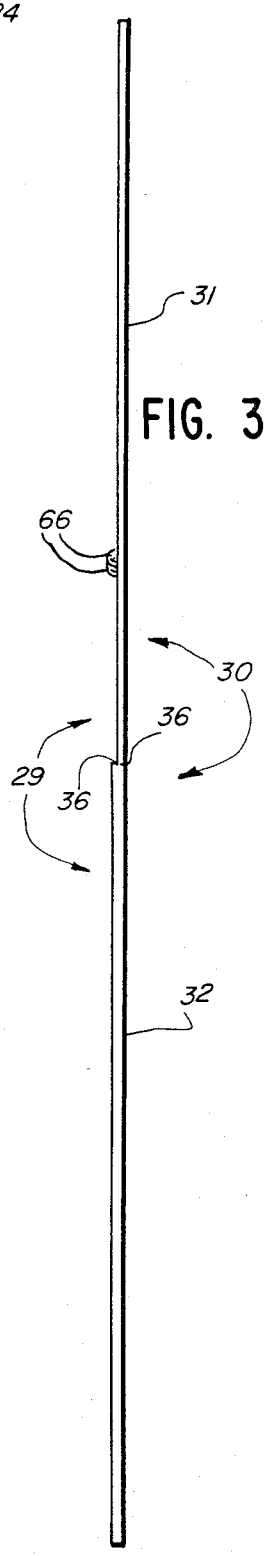
FIG. 3 is a side view of the sheet of FIG. 2.

To fashion the desired pattern of contacts 16 and terminal connectors 18, the pattern is cut from a sheet 28 of conductive material as shown in FIGS. 2 and 3. The sheet 28 has a top face 29 and a bottom face 30 and, according to the present invention, consists of a contact portion 31 and a terminal connector portion 32. To impart the desired characteristics of conductivity, flexibility and spring action, the conductive portion 31 consists of a first conductive material, preferably $0.006 \pm 0.0005''$ thick 521 grade "C" phosphor bronze, extra-hard temper with a minimum tensile strength of 97 to $112 \times 10^3$ psi and a Rockwell hardness of 30 T. It has been found that when the contacts 16 are fashioned from the aforestated material of the contact portion 31, that the contacts have the desired flexibility and spring action necessary to bias the contacts against the rotor for proper operation of the switch 10.

To provide a bearing surface to bear against the rotor of the switch 10, a portion of the contact portion 31 shown as strip 34 extends from left to right across the top face 29 of the sheet 28 as illustrated in FIG. 2. The strip 34 consists of a layer of low stress nickel inlaid over the contact portion 31 having a thickness of about 0.0002 inches with a layer of inlaid gold (for example, Western Electric Alloy #1) having a thickness of about 0.00005 inlaid over the nickel. Alternatively, strip 34 may be fashioned from a coin silver alloy having a thickness of about 0.0001±0.00003 inches inlaid over the contact portion 31. The strip 34 possesses the characteristics of durability and resistance to wear for the switch 10.

The terminal connector portion 32 is fashioned from a second conductive material, preferably hard copper approximately 0.016±0.0005 inches thick having on both the top and bottom faces 29 and 30 an inlaid layer of terminal connector tin (60/40 composition) alloy approximately 0.0002 to 0.0004 inches thick. The aforementioned composition of the terminal connector portion 32 imparts the desired characteristics of strength and durability to the terminal connectors fashioned therefrom.

To connect the contact and terminal connector portions 31 and 32 to form the sheet 28, the conductive materials are welded by, for example, electron beam welding to produce a weld 36 shown in FIGS. 2 and 3. A plurality of bores 37 positioned about the sheet 28 to receive pins (not shown) hold the sheet 28 during the operations described below.

Stamping of the desired pattern of contact 16 and terminal connectors 18 from the sheet 28 generates terminal connectors 18*a*–18*h* in the terminal connector portion 32 separated from each other and the remainder of the portion 32 by openings 38*a*–38*i*. Each terminal connector 18 has an end tab 40 joining the terminal connector 18 to a border 41 of the portion 32 to support the terminal connectors 18*a*–18*h* during the assembly steps set forth below. For additional support, webs 42*a*–42*i* at the ends of each terminal connector 18 opposite to the tabs 40 extend across the openings 38*a*–38*i* to interconnect the terminal connectors 18 to each other and to the portion 32.

Extending from each terminal connector 18*b*–18*g* is a contact 16 stamped from the contact portion 30 of the sheet 28. Each contact 16 has an end 43 disposed in said strip 34. Terminal connectors 18*a* and 18*h* are connected to legs 44 and 46 respectively which are part of a contact supporting framework 48.

The framework 48 has a first frame member 50 connected to and supporting the ends 43 of contacts 16. A second frame member 52 interconnects the ends of the legs 44 and 46 as illustrated in the drawings. To support the framework 48 and the connected contacts 16, a pair of spaced fingers 54 interconnect the second frame member 52 to the remaining contact portion 31 of the sheet 28. Additionally, flaps 56 connect each leg 44 and 46 and terminal connectors 18*a* and 18*h* to the sheet 28. Auxiliary contacts 58 and 59 interconnect the first and second frame members 50, 52 and have ends 62, 63 disposed in the strip 34. Depending upon the desired pattern and the structure of the rotor, the auxiliary contacts 58, 60 may, in cooperation with the second frame member 52 and legs 44 and 46, provide for the switching between terminal connectors 18*a* and 18*h*.

Either during or subsequent to the stamping of the contact-terminal connector pattern in the sheet 28, a semi spherical contact surface 66 is formed on the ends 43 of contacts 16 and auxiliary contact ends 62 at the strip 34. The surfaces 66 when the switch 10 is assembled, bear against the rotor to provide for switching between the contacts 16 and the connected terminal connectors 18*b*—18*b*, and, due to the material used in forming the strip 34, possess the desirable characteristic of durability and resistance to wear.

Figure 4:
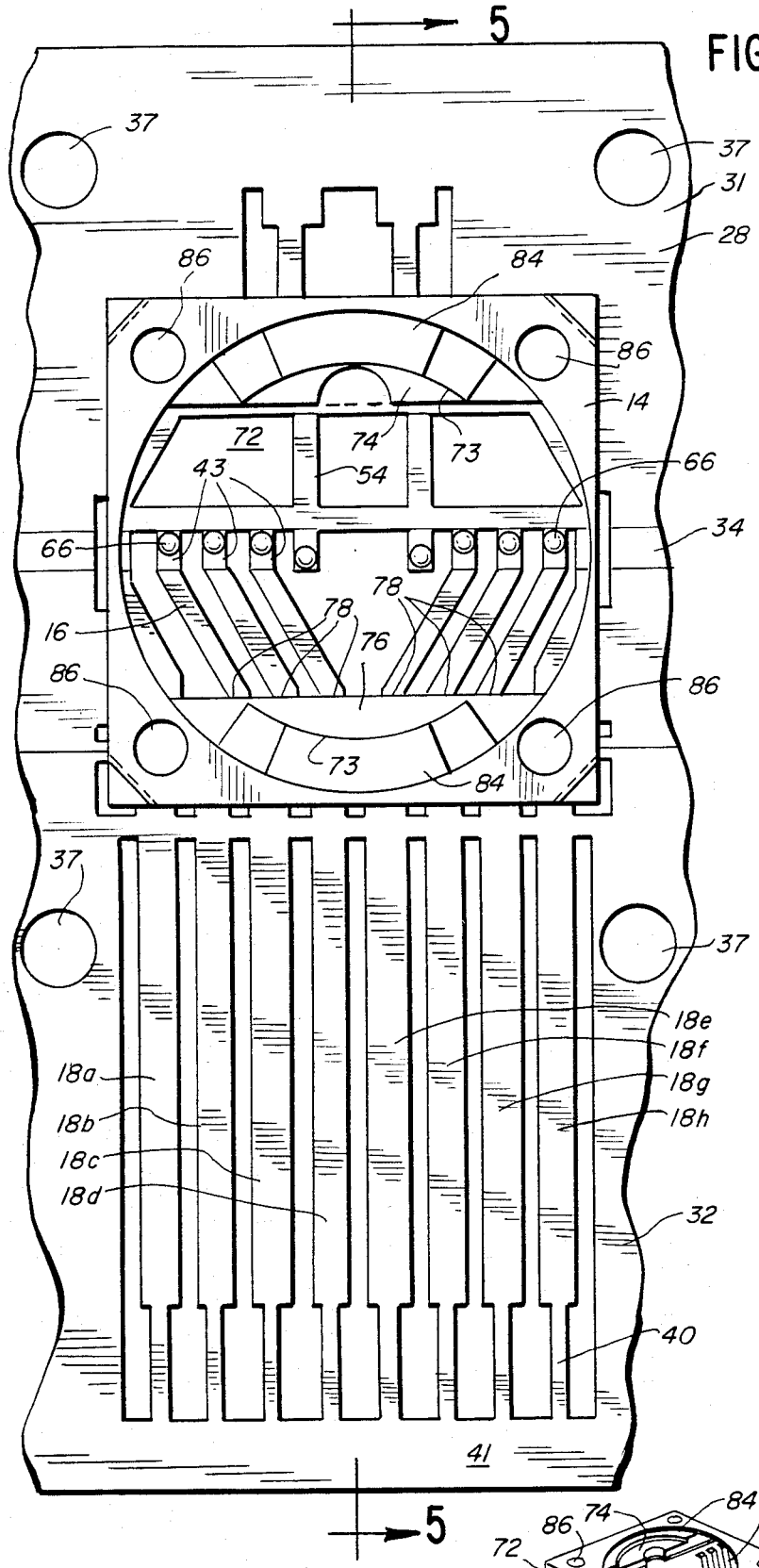
FIG. 4 is a plane view similar to that of FIG. 2 further showing a non-conductive carrier insert molded over the contact-terminal connector pattern.
Figure 5:
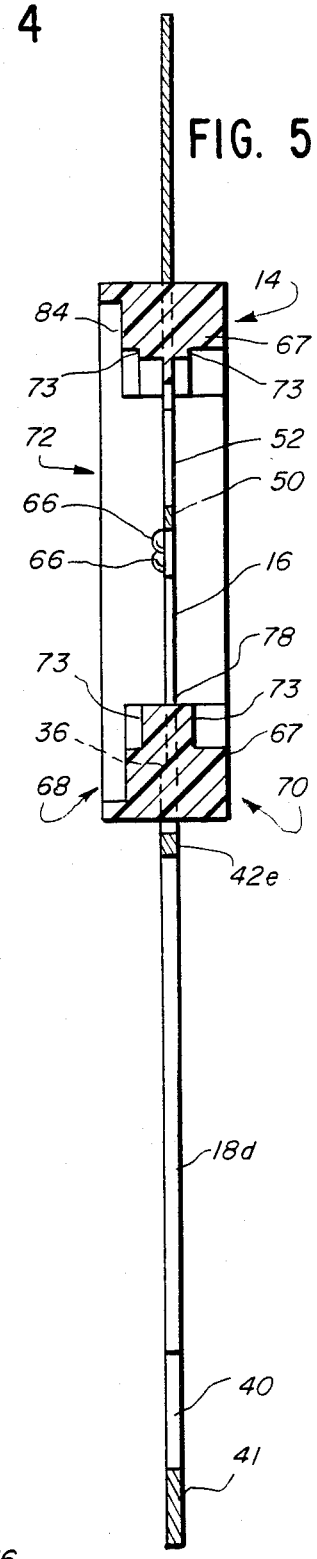
FIG. 5 is a section view along line 5—5 of FIG. 4.

To secure the sheet 28 and more particularly the contacts 16 and terminal connectors 18 into a structure to be assembled into the switch 10, the plastic carrier 14 is insert molded over the sheet 28. As seen in FIGS. 4 and 5, the carrier 14 has a rectangular body 67 with upper and lower surfaces 68 and 70. The body 67 covers the weld 36 and accordingly protects the weld 36 from stresses resulting during flexure of the contact 16 or bending of the terminal connectors 18.

To accommodate the flexure of the contacts 16 and rotation of the switch rotor, a central aperture 72 passes between the upper and lower surfaces 68 and 70 of the carrier 14. The body 67 surrounding the aperture 72 covers, to a great measure, the legs 44, 46 and second frame strip 52 and a portion of each contact 16 adjacent the weld 36. Accordingly, the body 67 firmly secures the contacts 16 and terminal connectors 18 within the carrier 14. Extending into the carrier 14 from each of the upper and lower surfaces 68 and 70 is a first countersink 73 which defines arcuate contact supports 74 and 76. The contact support 76, as seen in FIGS. 4 and 5, covers a portion of the contacts 16. Each contact 16 is free to flex about points 78 at the juncture between the contacts 16 and support 76 thereby protecting the weld 36 from stresses accompanying flexure of the contacts 16.

To accommodate the rotation of the rotor within the switch 10, the carrier 14 has a second countersink disposed in the upper surface 68 to define opposed, arcuate platforms 84. The rotor may, for example, bear against the platforms 84 to support the rotation thereof. Bores 86, the lower pair of which extend through openings 37, pass through the carrier 14 to receive rivets or the like during assembly of the switch 10.

Figure 6:
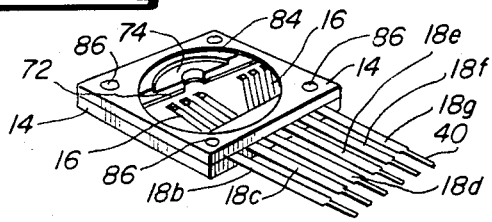
FIG. 6 is a perspective view of the contacts, terminal connectors and carrier prior to assembly into the switch.

Subsequent to the insert molding of the sheet 28 into the carrier 14, the sheet 28 is trimmed away from the carrier 14 and the border 41 is removed. To separate the terminal connectors 18 and contacts 16 from one another, the webs 42*a*–42*i* are also removed. Additionally, the framework 48 including auxiliary contacts 58 and 60 and the fingers 54 are trimmed to completely free the contacts 16. Since, in the embodiment shown in FIG. 6, terminal connectors 18*a* and 18*h* are not required, they are likewise trimmed from the carrier 14. Subsequent to the aforesaid trimming, the contacts 16 are bent about their flexure points 78 in a direction toward the upper surface 68 to, upon assembly of the switch 10, bear against the rotor thereof resulting in the configuration shown in FIG. 6. Since the contacts 16 are fashioned from a conductive first material exhibiting a biasing spring action, the contacts 16 and more particularly surfaces 66, will advantageously bear against and maintain contact with the rotor of the switch 10. Furthermore, since the terminal connectors 18*b*–18*g* are fashioned from a relatively rigid material, breakage is prevented. Additionally, the flexure of the contacts 16 and bending of the terminal connectors 18*b*–18*g* which may be required to connect the switch 10 to the circuit will not impose undue stress upon the weld 36 which might otherwise cause the weld 36 to break rendering the switch 10 useless.

While I have shown and described a specific embodiment of the present invention, it is to be understood that it is subject to many modifications without departing from the spirit and scope of the claims hereinafter set forth.

I claim:

1. A switch having a stator and a rotor, the improvement in the stator comprising:

a contact having a first sheet portion defined by a first, resilient, conductive material with a first edge to engage the rotor with spring pressure;

a terminal connector having a second sheet portion defined by a second material that is conductive and more rigid than the first material and a second edge; and means joining the sheet portions of the contact and terminal connector together along a subtstantial length of said first and second edges to define a composite flat sheet consisting of at least a part of the first sheet portion and at least a part of the second sheet portion, said composite flat sheet being thinner than the combined thickness of the first and second sheet portions; and carrier means supporting said composite flat sheet so that at least a part of the first sheet portion can flex as the rotor operates on the stator.

2. The stator of claim 1 wherein substantially the entire contact and entire terminal connector comprise flat sheets and the means joining the sheet portion of the contact and terminal connector comprises a butt weld.

3. The switch of claim 1 wherein said means joining the sheet portions comprises a weld.

4. The switch of claim 1 wherein the carrier means is made from an insulating material.

5. The switch of claim 1 wherein said means joining the sheet portions comprises a weld and the carrier is molded around the composite sheet portion to envelop at least a portion of the weld and thereby relieves the weld from mechanical stresses imposed on the contact and terminal connector.

6. The switch of claim 1 wherein said means joining the sheet portions comprises a butt weld.

* * * * *